US005778296A

United States Patent [19]

van der Steen et al.

[11] Patent Number: 5,778,296

[45] Date of Patent: Jul. 7, 1998

[54] XEROGRAPHIC CASSETTE WITH DUAL WASTE TONER STORAGE

[75] Inventors: Jan J. van der Steen, America; Ruud Vullers, Reuver; Marcel Kuipers, Venray; Jozef P. M. Logtens, Meerio, all of Netherlands; Roderick A. Cooley, Herts, United Kingdom; Derek J. Milton, Herts, United Kingdom; Andrew E. Taylor, Herts, United Kingdom; Stephen J. Abbott, Beds, United Kingdom

[73] Assignee: Xerox Corporation, Stamford, Conn.

[21] Appl. No.: 720,522

[22] Filed: Sep. 30, 1996

[30] Foreign Application Priority Data

Oct. 31, 1995 [GB] United Kingdom ..... 95 222 80

[51] Int. Cl.[6] ..... G03G 21/10; G03G 21/12

[52] U.S. Cl. ..... 399/360; 399/358

[58] Field of Search ..... 399/358, 360, 399/359, 99, 120

[56] References Cited

U.S. PATENT DOCUMENTS

| | | | |
|---|---|---|---|
| 4,325,628 | 4/1982 | Torigai et al. | 399/358 |
| 5,272,510 | 12/1993 | Reese et al. | 399/358 |
| 5,309,211 | 5/1994 | Yoshioka | 355/298 |
| 5,341,200 | 8/1994 | Thomas | 355/298 |
| 5,493,382 | 2/1996 | Takagaki et al. | 399/360 X |

FOREIGN PATENT DOCUMENTS

| | | |
|---|---|---|
| 59-147375 | 8/1984 | Japan . |
| 59-148080 | 8/1984 | Japan . |
| 1-134387 | 5/1989 | Japan . |
| 1-214888 | 8/1989 | Japan . |

*Primary Examiner*—Fred L. Braun
*Attorney, Agent, or Firm*—Tammy Fair; Annette L. Bade

[57] ABSTRACT

A xerographic cassette for a printing or copying machine includes a photoreceptor drum, a cleaning blade, and a waste toner conveyor for conveying waste toner cleaned off the photoreceptor drum by the cleaning blade into the interior of the photoreceptor drum for storage. The conveyor includes a flexible helical wire which acts as an auger. A curved tube portion of the conveyor passes through an auxiliary waste toner container. Once the auxiliary container is substantially full, waste toner is conveyed into the interior of the photoreceptor drum. The auxiliary container is provided with an aperture which enables it to be emptied, thereby prolonging the useful life of the cassette.

7 Claims, 4 Drawing Sheets

XEROGRAPHIC CASSETTE WITH DUAL WASTE TONER STORAGE

BACKGROUND OF THE INVENTION

This invention relates generally to an electrostatographic printer and copier, and more particularly, a xerographic cassette which includes at least an imaging surface and a cleaning device.

In xerographic printing and copying machines, it is commonplace to use a xerographic cassette which contains at least the photoreceptor, so that when the photoreceptor, or any other xerographic process item contained within the cassette, needs replacement, it can easily be replaced by simply removing the cassette and exchanging it for a new one. The cassette can be replaced either by the customer (a Customer Replaceable Unit or CRU) or by a service engineer (an Engineer Replaceable Unit or ERU). Process items often contained within a xerographic cassette are the corotrons and the cleaning device.

In the xerographic process, after the development of an electrostatic latent image with dry toner particles and the transfer of the developed image to a sheet of copy paper, any toner remaining on the photoreceptor surface is cleaned off by a suitable cleaning device. The cleaning device typically comprises a polyurethane cleaning blade. The cleaned off toner can then either be recirculated or stored for subsequent disposal. In general, better quality images are obtained by employing the latter technique, since fresh toner is always used for the development of images, rather than toner which could be contaminated by undesirable debris, such as paper fibers.

The storage of cleaned off, waste toner presents problems, however, in that a storage container needs to be provided, together with suitable means for delivering the waste toner to the container. In small machines space is at a premium, and a container for waste toner is not always easy to accommodate. One way of providing space for waste toner is to use the interior of the photoreceptor, which is a space that is otherwise substantially unused. In the case of a printer or copier using a cassette, this has the advantage that when the cassette is at the end of its useful life, it can be removed for disposal or recycling, taking the waste toner with it. A copying machine which uses this technique is the Xerox 5343 machine. In recent years, the reliability of xerographic components has increased to the point where many xerographic cassettes are reaching the end of their useful lives only because they have become full of waste toner, at which point a "replace cassette" warning is triggered, followed by a machine shutdown. In many is cases, the cassettes become full of toner at a point when they are only about half way through their useful lives.

It is an object of the present invention to provide a xerographic cassette which overcomes this problem, thereby improving cassette life.

The following disclosures may be relevant to various aspects of the present invention and may be briefly summarized as follows:

U.S. Pat. No. 5,309,211 to Yoshioka discloses a process unit mounted in a housing of a laser printer includes a developing device for supplying toner to a latent image formed on a photosensitive member so that a visible toner image corresponding to the latent image is formed on the photosensitive member, a first chamber provided adjacent to the developing device, a second chamber connected via an opening to the first chamber, and a feeding mechanism for feeding waste toner to the first chamber, the waste developer being removed from the photosensitive member by a cleaning device after the visible toner image is transferred to a recording sheet. Thereby, the waste developer fed to the first chamber is further fed via the opening to the second chamber so that the waste developer is stored in the first and second chambers.

U.S. Pat. No. 5,341,200 to Thomas discloses a removable process unit for an electrostatographic printing machine that has a photoreceptor, a frame having a longitudinal axis to movably mount the photoreceptor therein parallel to the longitudinal axis, a cleaning sump extending parallel to the longitudinal axis and adjacent the photoreceptor, a toner transport to transport toner cleaned from the photoreceptor toward one end of the sump, the toner sump having an aperture at one end, a cover for the frame at the one end thereof, the cover including a cavity with an aperture in communication with the aperture in the sump for storage of cleaned toner.

SUMMARY OF INVENTION

Briefly stated, and in accordance with one aspect of the present invention, there is provided a xerographic cassette for a printing machine and a copying machine comprising: an imaging surface, having an interior surface and an exterior surface opposed to one another; a cleaning device for removing particles from the imaging surface; means for conveying the particles removed from the imaging surface into the interior surface of the imaging surface using the cleaning device, the interior surface of the imaging surface forming a storage container for holding the particles collected therein; and an auxiliary storage container being positioned adjacent to the storage container, the conveying means passes through the auxiliary storage container, the conveying means being adapted to release particles into the auxiliary storage container until the auxiliary storage container is substantially full, whereafter the particles of the auxiliary container being conveyed into the storage container, and the auxiliary storage container defining an aperture therein enabling emptying of the auxiliary waste container.

Pursuant to another aspect of the present invention, there is provided a xerographic cassette for a printing or copying machine, the cassette including at least a photoreceptor drum and a cleaning device, and waste toner conveying means for conveying waste toner, cleaned off the photoreceptor drum by the cleaning device, into the interior of the photoreceptor drum for storage, characterized by an auxiliary waste toner container through which the conveying means passes, the conveying means being adapted to release toner into the auxiliary waste toner container until the container is substantially full, whereafter waste toner is conveyed into the drum, and the auxiliary container being provided with access means to enable it to be emptied.

BRIEF DESCRIPTION OF THE DRAWINGS

Other features of the present invention will become apparent as the following description proceeds and upon reference to the drawings, in which.

Figure 1:
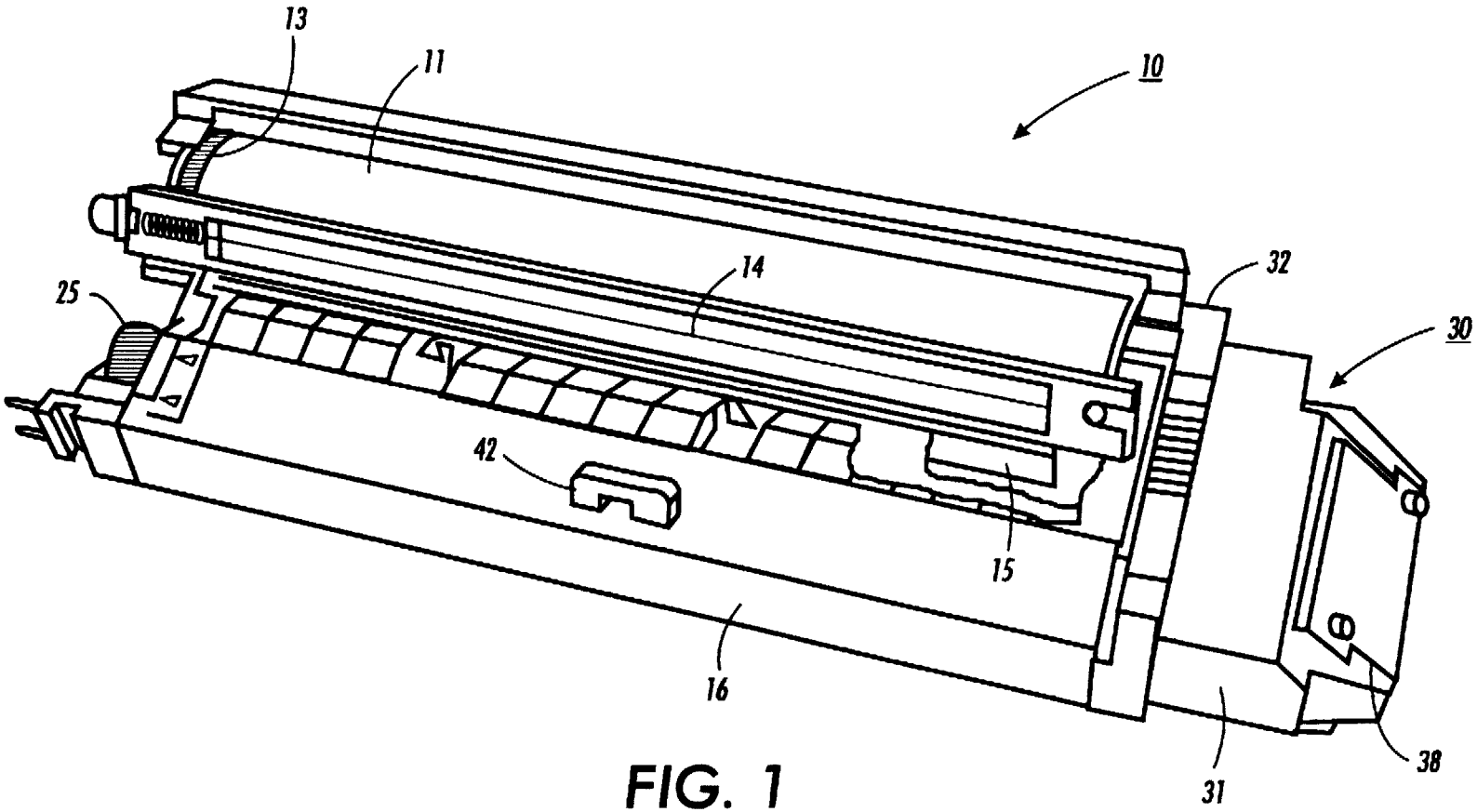
FIG. 1 is a perceptive view, from above, of a xerographic cassette incorporating the invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

According to the present invention, there is provided a xerographic cassette for a printing or copying machine, the cassette including at least a photoreceptor surface (e.g. photoreceptor drum) and a cleaning device, and waste toner conveying means for conveying waste toner, cleaned off the photoreceptor drum for storage, characterized by an auxiliary waste toner container until the container is substantially full, whereafter waste toner is conveyed into the drum, and the auxiliary container being provided with access means to enable it to be emptied.

By using a cassette in accordance with the invention, it is possible for a service engineer to empty the auxiliary waste toner container from time to time (for example when the service engineer visits the machine for other service matters), thereby prolonging the life of the cassette.

Referring now to the drawings, where the showings are for the purpose of describing a preferred embodiment of the invention and not for limiting same.

Figure 2:
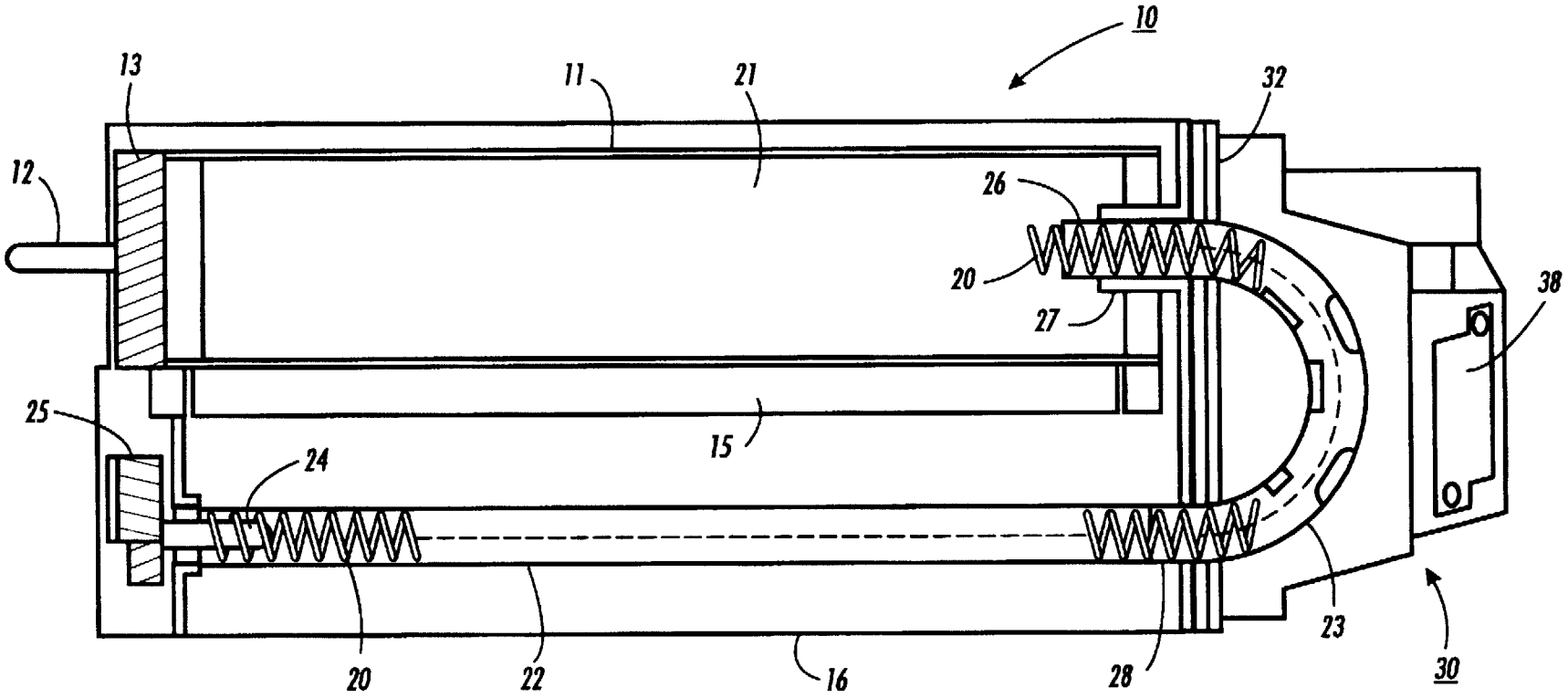
FIG. 2 is a simplified, diagrammatic plan view, partly in section, of the xerographic cassette incorporating the invention.

Referring to FIGS. 1 and 2, the xerographic cassette 10 includes a photoreceptor drum 11 which is mounted for rotation in the cassette, with its rotational axis located by a locating shaft 12, and being driven by gear teeth 13 formed around its circumference at one end. The locating shaft 12 engages in a suitable bearing (not shown) within the printer or copier that receives the cassette. The other end of the drum 11 is supported for rotation by a sleeve bearing 27. In addition to the photoreceptor drum 11, the cassette includes a corotron 14 and a cleaning device which has a cleaning blade 15 mounted within a cleaner housing 16. The cleaning blade 15, which may be, for example, of polyurethane material, engages the surface of the photoreceptor drum 11 so that as the photoreceptor drum rotates, waste toner is scraped off the drum surface and falls into the cleaner housing 16. The xerographic cassette 10 described here is intended as an engineer replaceable unit, i.e. one which is quickly and easily replaced by a service engineer.

Waste toner which has fallen into the cleaner housing 16 is conveyed by means of an auger 20 into the interior 21 of the photoreceptor drum 11. The auger consists of a helical spring wire which runs in a part-cylindrical channel 22 in the bottom of the cleaner housing 16, and also extends through a curved tube 23 which turns through an angle of about 180 degrees, to link the end of the channel 22 with the interior 21 of the photoreceptor drum. The auger 20 terminates at about the end of the tube 23 within the interior 21 of the drum. The auger 20 is driven, at its end remote from the curved tube 23, by a drive shaft 24 which in turn is driven from a drive within the printer or copier through a gear wheel 25. The end 26 of the curved tube 23 within the photoreceptor drum 11 passes through the end wall of the photoreceptor drum, within the sleeve bearing 27, and is centered on the rotational axis of the photoreceptor drum. The sleeve bearing 27 includes a seal which prevents the escape of toner. The other end 28 of the curved tube 23 is secured into the end wall of the cleaner housing 16.

Figure 3:
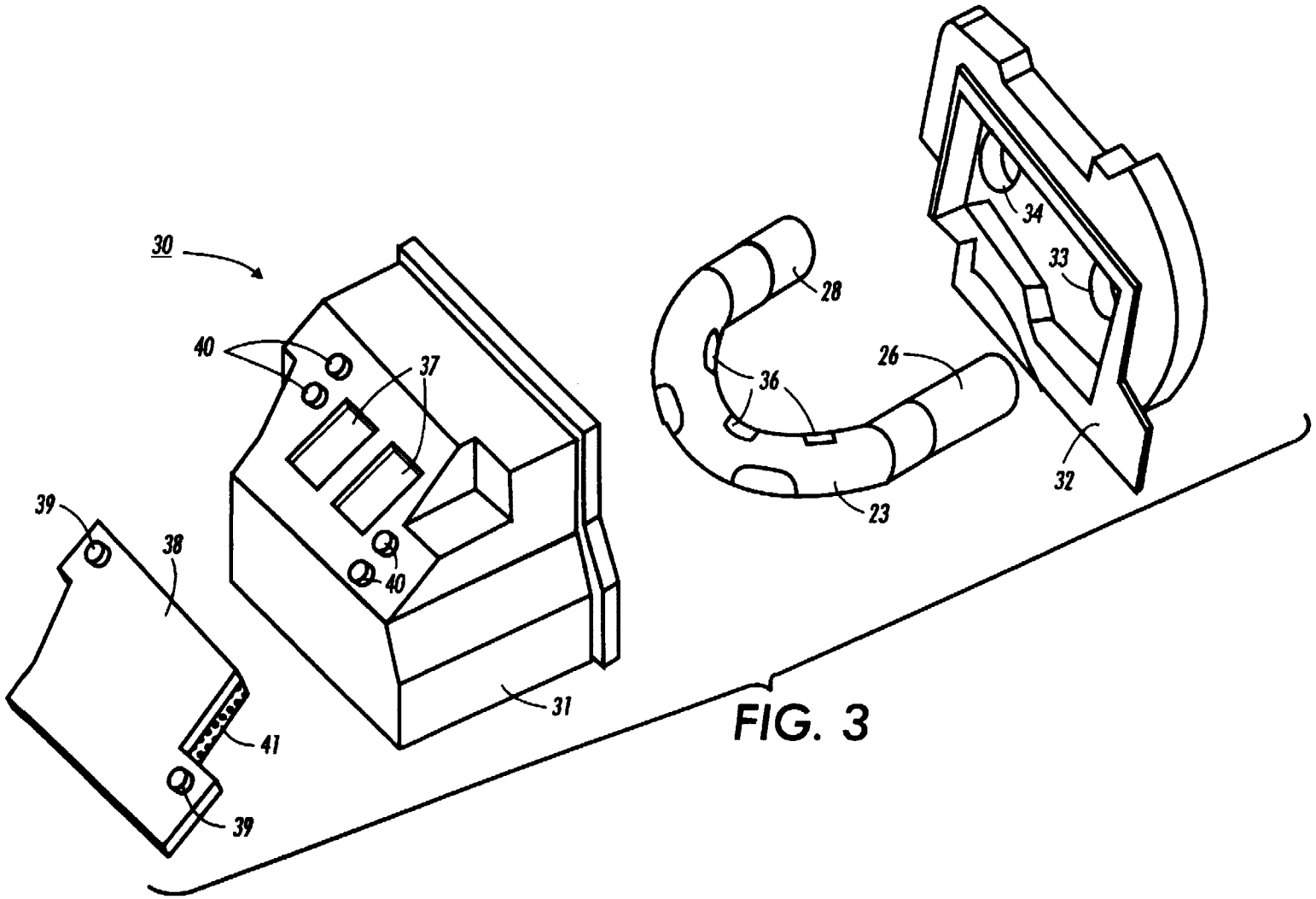
FIG. 3 is an exploded perspective view of an auxiliary waste toner container which forms part of the xerographic cassette of the invention.
Figure 4:
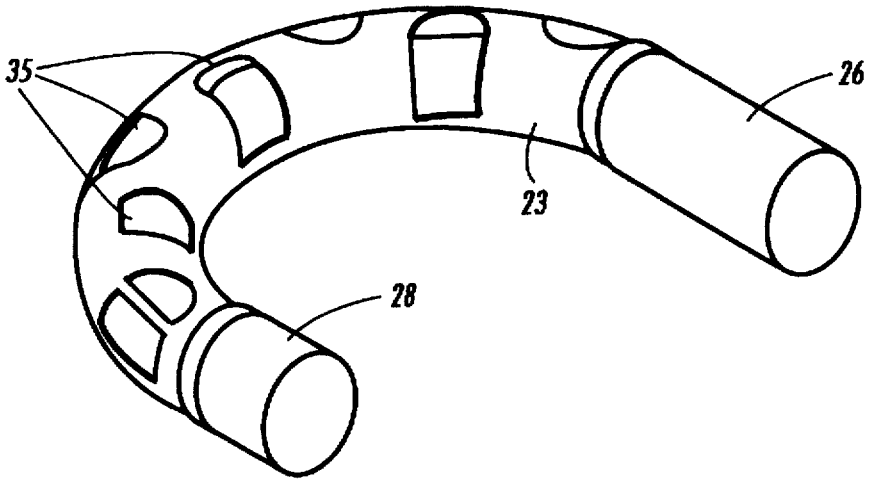
FIG. 4 shows, in an inverted position, the auger tube portion of the container of FIG. 3.

The curved tube 23 passes through an auxiliary waste toner container 30, and is perforated to allow the release of toner into the auxiliary container 30. Referring now to FIG. 3, which shows the elements of the auxiliary container 30. The auxiliary container comprises a box portion 31 and an end wall 32. The box portion 31 is sealed to the end wall 32, which in turn also forms an end wall of the cassette 10. The curved tube 23 is supported in the end wall 32 by means of two circular holes 33 and 34 (see FIG. 3), which receive the ends 26 and 28 respectively of the curved tube. As previously mentioned, the tube 23 is perforated so that it can release toner into the auxiliary container 30. As shown in FIG. 4, the tube 23 is in an inverted position, the underside of the tube 23 has several perforations 35, which are of such sizes, shapes and spacings as to produce a substantially even distribution of toner over the auxiliary container 30. Also, as shown in FIG. 3, there are a few perforations 36 in the upper half of the tube 23, for the reason given below.

Continuing reference to FIG. 2, as the auger 20 rotates during operation of the printer or copier that uses the cassette, cleaned off waste toner falls to the bottom of the cleaner housing 16, from where it is conveyed, along channel 22, towards the end 28 of curved tube 23. Once inside the tube 23, the toner is conveyed around the tube 23, being released through the perforations 35 (see FIG. 4) into the auxiliary container 30. At this stage, little, if any, waste toner is conveyed into the interior 21 of the photoreceptor drum 11. Thus, as the cassette is used, waste toner accumulates in the auxiliary container 30.

Referring now to FIG. 3, from time to time, a service engineer is likely to visit the machine (or even other machines in the vicinity), and is thus able periodically to empty the auxiliary container 30, for example by using a vacuum cleaner through the access apertures 37 in the upper part of the box portion 31. These access apertures are normally closed by a lid 38, which has two screw holes 39 in opposite corners, to enable the lid 38 to be secured in place by self tapping screws which engage two of four studs 40 located adjacent the access apertures. Four studs are provided so that if the self tapping screws strip the threads in the studs after repeated use, the other pair can be used by rotating the lid through 180 degrees. The underside of the lid 38 is provided with a foamed plastic pad 41 to seal the access apertures 37.

When the auxiliary container becomes substantially full, which in this context means up to the middle portion of the tube 23, waste toner will be conveyed all the way round the tube 23 until it is deposited into the interior 21 of the drum 11. Toner conveyed into the drum in this way will tend to distribute itself evenly along the drum due to the rotation of the drum. Once inside the drum, toner will stay there. If, however, a service engineer calls after toner has started filling the drum, the service engineer can nevertheless empty the auxiliary container 30, so that sufficient elapse of time occurs before further toner is deposited in the photoreceptor drum. Eventually, if the photoreceptor drum becomes substantially full, which implies that the auxiliary container is also full, the waste toner will then be delivered out of the perforations 36 in the upper half of the tube 23, thereby further filling the auxiliary container, which once again can be emptied by a service engineer. Finally, if the auxiliary container 30 becomes so full that no more toner can be accommodated, the toner will build up in the cleaner housing 16, eventually actuating a switch 42 (see FIG. 1) that sends a "replace cassette" signal to the printer or copier, and leading to a machine shutdown signal.

In practice, it has been found that by using a cassette in accordance with the invention, with periodic emptying of the auxiliary container, the useful life of the cassette can often be doubled.

In recapitulation, the present invention utilizes a xerographic cassette that has an auxiliary toner storage container positioned next to a waste toner storage container. A flexible auger in a cylindrical tube, through which the collected waste toner removed from the imaging surface moves, passes through the auxiliary storage container. The cylindrical tube (or similar carrying device for waste toner particles) has one or more perforations enabling release of the waste toner particles from the tube into the auxiliary waste toner storage container. A technical service representative periodically empties the auxiliary waste toner storage container. However, when the auxiliary waste storage container is substantially full and has not been emptied, waste toner continues in the tube past the auxiliary waste toner storage container and is released into the interior of the drum through perforation in the tube. The cylindrical tube and the auxiliary container, with periodic emptying, increase the life of the xerographic cassette.

It is, therefore, apparent that there has been provided in accordance with the present invention, a xerographic cassette that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A xerographic cassette for a printing machine and a copying machine comprising:

an imaging surface, having an interior surface and an exterior surface opposed to one another;

a cleaning device for removing particles from said imaging surface;

means for conveying the particles removed from said imaging surface into the interior surface of the imaging surface, the interior surface of the imaging surface forming an interior imaging storage container for holding the particles collected therein; and an auxiliary waste toner storage container being positioned adjacent to said interior imaging storage container, said conveying means passes through said auxiliary waste toner storage container, said conveying means being adapted to release particles into said auxiliary waste toner storage container until said auxiliary waste toner storage container is substantially full, whereafter the particles of said auxiliary waste toner storage container being conveyed into said interior imaging storage container, and said auxiliary waste toner storage container defining an aperture therein enabling emptying of said auxiliary waste toner storage container.

2. A xerographic cassette as recited in claim 1, wherein said imaging surface comprises a drum.

3. A xerographic cassette as recited in claim 2, wherein said conveying means comprises a flexible auger arranged over at least a portion of the length of said flexible auger to rotate in a substantially cylindrical tube, the tube having a curved portion where the tube turns through about 180 degrees, to enable the particles to be conveyed in a first direction alongside the drum, extending beyond one end of the drum, and bending back toward the end of the drum and into the interior of the drum.

4. A xerographic cassette as recited in claim 3, wherein at least a portion of the tube passes through said auxiliary storage container, the tube having at least one perforation therein positioned to release particles into the auxiliary storage container from the tube.

5. A xerographic cassette for a printing or copying machine, the cassette including at least a photoreceptor drum and a cleaning device, and waste toner conveying means for conveying waste toner, cleaned off the photoreceptor drum by the cleaning device, into the interior of the photoreceptor drum for storage, characterised by an auxiliary waste toner storage container through which the conveying means passes, the conveying means being adapted to release toner into the auxiliary waste toner storage container until the auxiliary waste toner storage container is substantially full, whereafter waste toner is conveyed into the interior of the photoreceptor drum, and the auxiliary waste toner storage container being provided with access means to enable it to be emptied.

6. The cassette of claim 5, wherein the conveying means is a flexible auger arranged over at least part of its length to rotate in a substantially cylindrical tube, the tube having a curved portion wherein the tube turns through about 180 degrees, to enable waste toner to be conveyed in a first direction alongside the photorecptor drum, beyond one end of the photoreptor drum, and back into the interior of the photorecptor drum.

7. The cassette of claim 6, wherein at least a portion of the tube passes through the auxiliary waste toner storage container, and has one or more apertures in said portion, to release waste toner into the auxiliary waste toner storage container.

* * * * *